US005558236A

United States Patent [19]

Williams et al.

[11] Patent Number: 5,558,236

[45] Date of Patent: Sep. 24, 1996

[54] REFRESHMENT RACK

[76] Inventors: Robert N. Williams, 438 Woodbridge, San Luis Obispo, Calif. 93401; Brian N. Williams, 3396 E. Antler Way, Salt Lake City, Utah 84121

[21] Appl. No.: 210,146

[22] Filed: Mar. 17, 1994

[51] Int. Cl.[6] ..... A47F 7/00

[52] U.S. Cl. ..... 211/74; 211/181; 248/312; D7/704

[58] Field of Search ..... 211/74, 181, 75, 211/106; 248/153, 312, 175, 107; D7/602, 704

[56] References Cited

U.S. PATENT DOCUMENTS

| | | | |
|---|---|---|---|
| D. 45,362 | 3/1914 | Woodside . | |
| D. 182,395 | 4/1958 | Ahlenius | D58/26 |
| D. 185,884 | 8/1959 | Cross | D7/704 |
| D. 233,723 | 11/1974 | Gutiervez | D7/704 |
| D. 250,625 | 12/1978 | Leventhal | D6/188 |
| D. 252,065 | 6/1979 | Leventhal | D7/70 |
| D. 255,520 | 6/1980 | Lyons | D6/188 |
| 611,857 | 10/1898 | Buck . | |
| 829,950 | 9/1906 | Conlin | 248/153 X |
| 1,158,059 | 10/1915 | Klauberg . | |
| 1,298,559 | 3/1919 | Phipps | 248/312 |
| 1,633,083 | 6/1927 | Fite . | |
| 2,155,884 | 4/1939 | Barnes | 211/74 |
| 2,262,597 | 11/1941 | Watral | 65/53 |
| 2,338,310 | 1/1944 | Barnes | 211/74 |
| 2,517,244 | 8/1950 | Rundell | 211/181 X |
| 2,703,689 | 3/1955 | Williams | 248/153 |
| 2,819,860 | 1/1958 | Orbach | 248/128 |
| 2,925,235 | 2/1960 | Jaros | 211/153 |
| 2,951,590 | 9/1960 | Feser | 248/312 X |
| 3,901,389 | 8/1975 | Belokin, Jr. | 211/74 |
| 3,908,948 | 9/1975 | Hawthorne | 248/312 X |
| 4,482,065 | 11/1984 | Altemose | 211/74 |
| 4,496,124 | 1/1985 | Cole | 248/146 |
| 4,515,334 | 5/1985 | Horne | 248/146 |
| 4,795,038 | 1/1989 | Johnson | 211/74 |
| 4,836,476 | 6/1989 | Wolf | 248/146 |
| 4,944,415 | 7/1990 | Orbach | 211/181 X |
| 5,180,066 | 1/1993 | McArdle | 211/74 |
| 5,197,612 | 3/1993 | Thomson | 211/74 |
| 5,402,899 | 4/1995 | Ammeson | 248/153 X |

*Primary Examiner*—Robert W. Gibson, Jr.
*Attorney, Agent, or Firm*—Prince, Yeates & Geldzahler

[57] ABSTRACT

A refreshment rack is constructed of structural material formed into a stable base having an inclined planar rod loop extending from the base. The rod loop defines an opening for inserting a long, narrow neck bottle, as in a wine bottle, and supporting the bottle essentially horizontally in cantilever fashion upon release. The base is adapted to receive a plurality of service trays for food that compliments the bottled beverage. The rack also includes a plurality of drinkware holders for holding beverage-related drinkware.

19 Claims, 3 Drawing Sheets

REFRESHMENT RACK

BACKGROUND OF THE INVENTION

1. Field of the Invention

The present invention relates to a refreshment rack or holder, and more particularly relates to an aesthetic, easily transportable holder for a narrow-necked bottle, drinkware, and accessories.

2. Description of the Prior Art

There presently exist various designs for holding a long-necked bottle in free-standing, cantilever fashion. Many of these such devices incorporate a vertical or slightly inclined support having a plurality of throughholes therein for receiving the neck of a bottle to be supported in cantilever fashion. U.S. Pat. No. 4,795,038 shows adjacent parallel inclined supports having offset holes for supporting the bottles by their necks. U.S. Pat. Nos. 5,180,066 and 4,496,124 incorporate a base extending essentially parallel to the bottle axis (horizontal) and below the bottle center of gravity in order to stabilize the bottle. U.S. Pat. No. 5,197,612 incorporates two inclined bottle supports attached together in the form of an "X" in order to support each other and a bottle in each of the bottle supports. Other designs are directed specifically to wine bottles, and incorporate supports at the neck end and base end of the bottle for supporting the bottle in slightly tilted orientation either toward or away from the bottle cork.

These various prior art devices are designed solely for holding one or more long-necked bottles and generally a horizontal orientation, some in cantilever fashion. None of these prior art patents shows a refreshment rack for holding a long-necked bottle in cantilever fashion as herein disclosed, or having integrated drinkware holding components or other ancillary components for holding complimentary snack food items integrated into the base of the rack.

SUMMARY OF THE INVENTION

In its simplest form, the refreshment rack of the present invention comprises a base and bottle holder constructed of a metal or non-metal structural rod frame, the bottle holder comprising a loop of rod within a plane at an angle and sized. to support the long narrow neck of such a bottle in cantilever fashion directly above and parallel to the base. Various embodiments of the refreshment rack include the provision for holding a plurality of bottles, the addition of two or more drinkware holders for holding drinkware for use with the bottled beverage, and the addition of a food service tray or holder, as in a bowl, for holding snack foods to accompany the bottled beverage. The drinkware holders may take the form of an open horizontal circular loop for receiving therein the stem of a wine glass or the like, the loops being open for easy insertion and removal of stemmed wine glasses. Variations of stemware holders include closed loops for holding tumblers, shot glasses, etc. and vertically oriented open loops for supporting handled drinkware, as in a cup or mug.

A further embodiment of the rod refreshment rack comprises a rod rack support stand adapted to be attached to a vertical wall for holding a plurality of long-necked bottles, as in wine bottles, displayed in the ornamental rack.

DETAILED DESCRIPTION OF THE INVENTION

Figure 1:
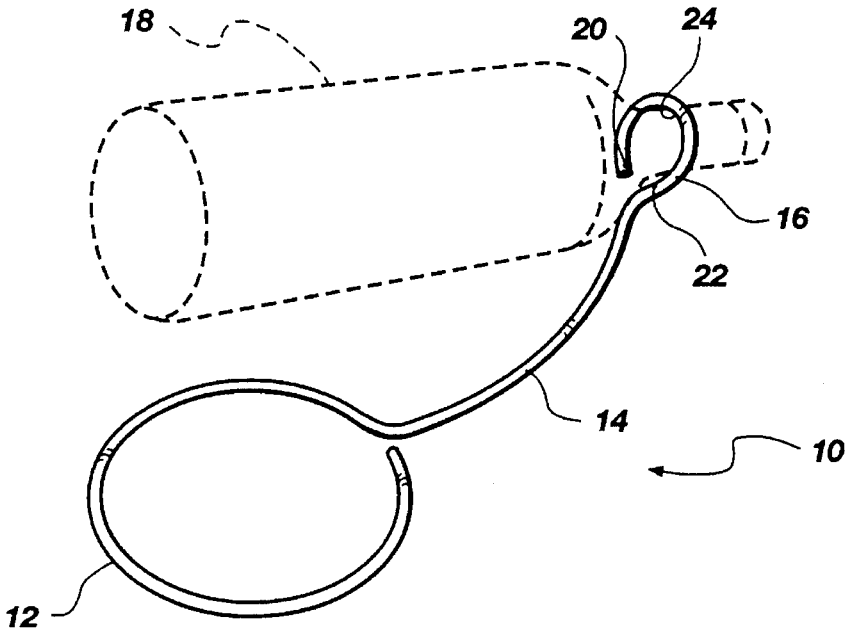
FIG. 1 is a perspective view of the refreshment rack of the present invention in its simplist form for holding a long-necked bottle in cantilever fashion.

FIG. 1 is a perspective view of the refreshment rack of the present invention in its simplist form, generally illustrated by the numeral 10. The basic refreshment rack comprises a base 12 constructed of a section of rod formed in a circular configuration, the rod extending into an arcuate transition section 14, and terminating in an incomplete loop 16. A long-necked bottle, as in a wine bottle, is shown in phantom in FIG. 1 to illustrate the manner in which the refreshment rack will support the bottle in cantilever fashion by positioning the bottle neck within the incomplete loop 16. The mass of the base 12 is greater than that of the arcuate transition section 14 and incomplete loop 16 so that the rack is stable when empty (without a bottle). With a bottle resting in the incomplete loop 16, the center of gravity of the unit (rack and bottle) is over an approximate mid-point of the base, in order to increase the stability when the rack is supporting a bottle. In addition, the base 12 may include a non-skid bottom surface that prevents the rack from slipping on its support surface, and also prevents the rack from scratching or marring the support surface.

The incomplete loop 16 is of a size to permit ease of insertion of the neck of a long-necked bottle thereinto. In addition, the loop 16 is oriented within a plane at a specific angle relative to vertical, in order to support a typical long-necked bottle in cantilever fashion essentially parallel to the plane of the base, i.e., essentially horizontal. The inside diameter of the loop 16 and the particular angle of the plane of the loop relative to vertical combine to define three stabilizing contact points between the inside diameter of the loop and the bottle neck in a manner to stabilize the bottle in cantilever fashion directly over the base 12.

When in stable position within the loop 16, the bottle 18 contacts the inside diameter of the loop at three stabilizing points of contact 20, 22, 24. The neck of the bottle rests upon the two lower contact points of the loop 20 and 22, which define a "V" for receiving the round surface of the bottle neck therein. The bottle neck is cantilevered within the loop by its engagement with the loop inside diameter upper point of contact 24. The plane of the loop 16 is at a substantial angle relative to vertical for the purpose of maximizing the horizontal distance between the upper and lower points of contact of the bottle with the loop, 24 and 20, 22, respectively, in order to maximize the stabilizing effect of the three-point cantilever support. Of course, the inside diameter of the loop and the particular angle of the slope of the loop plane are determined by the particular bottle neck diameter in order that the bottle will be held essentially horizontally within the loop.

Figure 2:
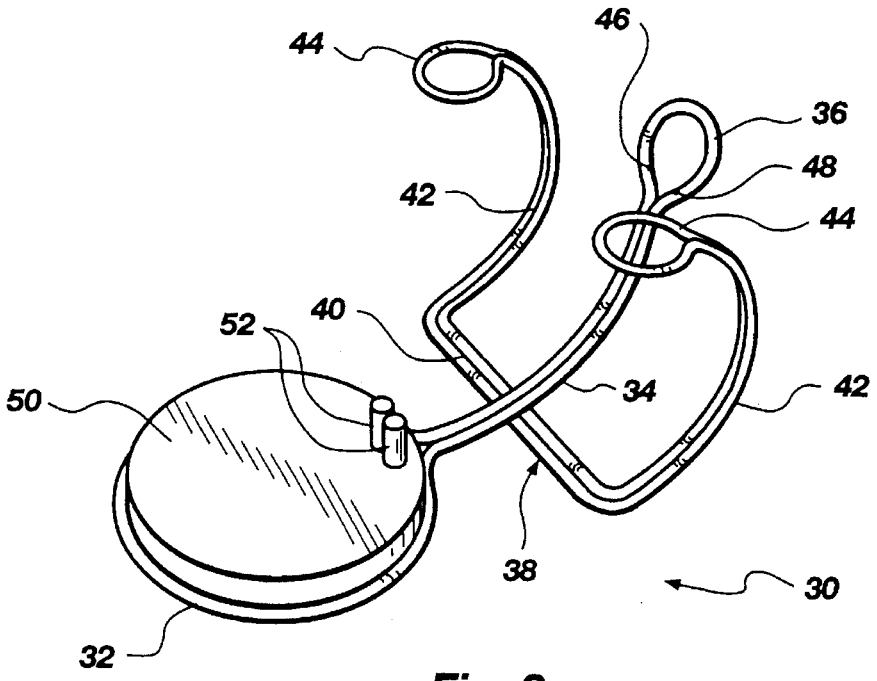
FIG. 2 is a perspective view of a second embodiment of the refreshment rack of the present invention illustrating the drinkware holders.

FIG. 2 is a perspective view of a second embodiment of the refreshment rack, generally illustrated at 30. The embodiment of FIG. 2 comprises a base 32 constructed of a rod formed in a circular configuration, the rod extending into an arcuate transition section 34, the arcuate transition section terminating in a closed loop 36. In this embodiment 30 of FIG. 2, the base 32, arcuate transition section 34 and closed loop 36 comprise a single, endless piece of rod that defines a closed loop for the base and the closed loop 36 for holding the neck of the bottle.

The embodiment of FIG. 2 also includes a supplemental drinkware holder 38, also constructed of rod formed in the configuration shown. The drinkware holder 38 includes a transverse section 40 which is brazed, welded or otherwise attached to the rack arcuate transition section 34 in a manner suitable for the particular material. The transverse section 40 transforms into a pair of essentially identical arcuate sections 42, each terminating in a closed loop drinkware holder 44 for receiving and holding drinkware therein. In this embodiment of FIG. 2, the closed loop drinkware holders 44 are designed to receive therethrough the bases of drinkware with a base diameter less than the bowl diameter, such as some stemmed wine or champagne glasses, the closed loop drinkware holder supporting the bowl of the glass. In addition, the closed loop drinkware holders 44 are also adapted to hold conventional tapered glassware, such as shot glasses.

The closed loop 36 is adapted to support a long-necked bottle in cantilever fashion, in a manner identical to the FIG. 1 embodiment. The closed loop design of the loop 36, however, provides more stability to the three-point cantilever bottle mounting, in that the two lower points of contact 46, 48 of the bottle with the loop are both supported by the arcuate transition section 34. In this regard, the parallel arcuate rods of the arcuate transition section 34 may be brazed or otherwise attached together in order to increase the structural integrity of the refreshment rack of FIG. 2. Likewise, the two parallel rods comprising the supplemental drinkware support 38 may be brazed or otherwise attached together along the transverse section 40 and the arcuate sections 42.

The refreshment rack of FIG. 2 also includes a removable food serving tray 50. In this particular embodiment, the removable food serving tray takes the form of a cheese cutting and serving tray for serving a block of cheese thereon. This cheese service tray includes a pair of parallel dowels 52 for supporting a cheese cutting knife (not shown) in a customary manner. The serving tray 50 includes an annular concave groove (not clearly shown), into which the rod ring base is adapted to "spring/snap" in a manner to retain the tray within the base, yet permit the tray to rotate within the base for convenient access.

Figure 3:
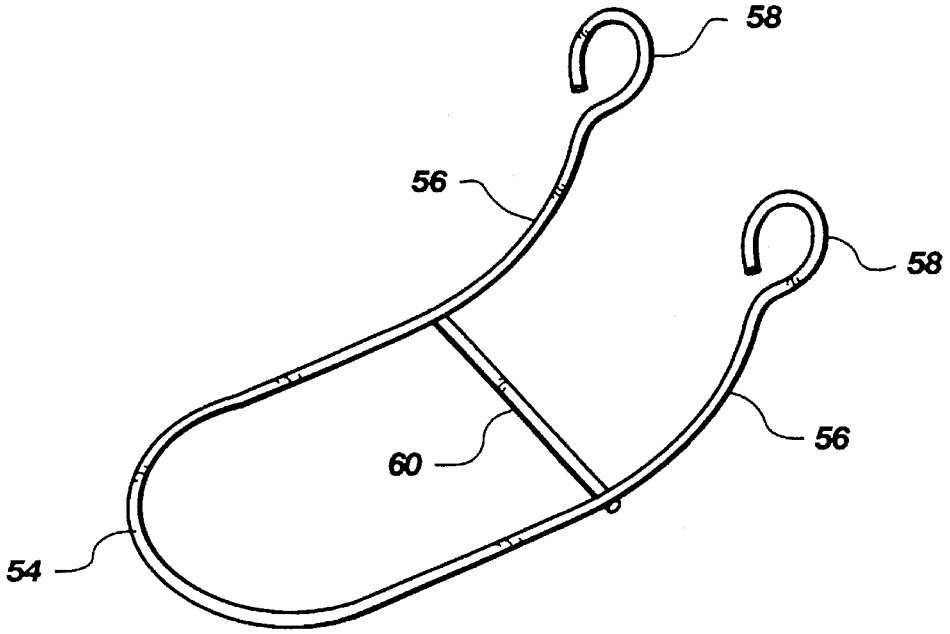
FIG. 3 is a perspective view of the refreshment rack similar to FIG. 1, illustrating the concept of a multiple bottle rack.

FIG. 3 is a perspective view of a refreshment rack similar to that shown in FIG. 1, illustrating the concept of a multiple bottle rack. The rack of FIG. 3 comprises a base 54 constructed of a rod formed into a "U" section, the ends of the rod transforming into essentially parallel arcuate transition sections 56, each transition section terminating in an incomplete loop 58. The two loops are essentially coplanar and sized and angled to support a plurality of long-necked bottles similarly in cantilever fashion.

The embodiment of FIG. 3 also includes a rod transverse section 60 brazed or otherwise attached to the juncture of the base 54 and the arcuate transition sections 56 in a manner to stabilize the rack. This FIG. 3 embodiment is adapted to support a plurality of long-necked bottles in cantilever fashion, in identical manner to the embodiments of FIGS. 1 and 2. In addition, a number of racks of the FIG. 3 embodiment may be brazed or otherwise formed together to result in a refreshment rack capable of supporting a number of bottles in horizontal and/or vertical orientation.

Figure 4:
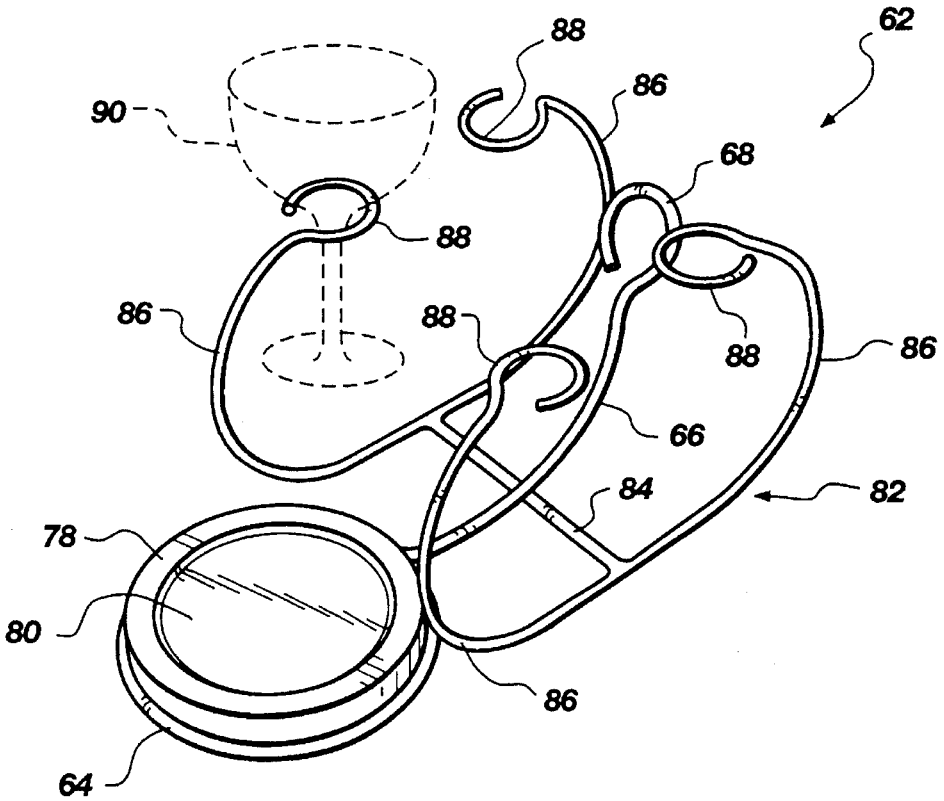
FIG. 4 is a perspective view of a refreshment rack similar to that shown in FIG. 2, illustrating the open-loop drinkware holder for holding stemware.

FIG. 4 is a perspective view of a fourth embodiment of a refreshment rack similar to that shown in FIG. 2, illustrating the open-loop drinkware holder for stemware. As in previous embodiments, this embodiment 62 of FIG. 4 comprises a base 64 constructed of rod formed in an essentially circular pattern defining an incomplete loop. The base rod transforms into an arcuate transition section 66, and terminates in an incomplete loop 68 for receiving the neck of a bottle in cantilever fashion therein, as in the previous embodiments. The refreshment rack 62 of the FIG. 4 embodiment also includes a removable base insert 78 defining a coaster of a size and shape to receive the bottom of a conventional wine bottle therein in upright orientation after the bottle has been opened. This removable base insert 78 includes a circular depression 80 for receiving the base of the bottle therein. A decorative cork or blotter paper insert (not shown) may also fit within the depression 80 for absorbing beverage rundown from the bottle.

The refreshment rack 62 of FIG. 4 also includes a supplemental drinkware support 82 comprising a transverse section 84 brazed or otherwise attached to the arcuate transition section 66 as previously described. The supplemental drinkware support 82 includes four arcuate transition sections 86 brazed or otherwise attached to the transverse section 84, the transition sections each terminating in a respective open loop 88 for receiving stemmed drinkware 90 therein. Those skilled in the art will readily appreciate that the rod loop 88 is open sufficiently to permit a user to slide the stem of a wine glass or the like 90 in through the opening in the loop, and rest the bowl of the wine glass on the circular portion of the loop. In this manner, stemmed drinkware are supported by their bowls rather than their less stable bases.

Those skilled in the art will also appreciate that the drinkware support 82 is so sized and positioned to support stemmed drinkware such that the respective drinkware stems "nest" closely adjacent the body of a bottle held in the rack, with the stemware bases being positioned essentially below the bottle and the stemware bowls being positioned above the bottle. In this manner with the stemware positioned in close proximity with the bottle, the fully loaded refreshment rack is more stable, due to its narrow design, and is more streamlined and occupies less room on its support surface, e.g., coffee table.

Figure 5:
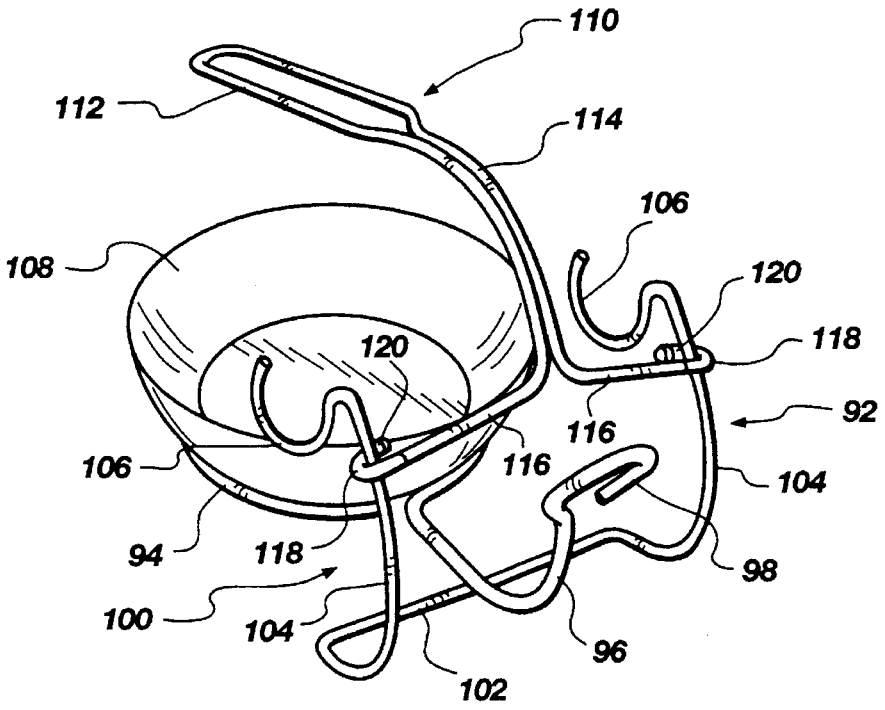
FIG. 5 is a perspective view similar to FIGS. 2 and 4, illustrating the removable handle attached to the refreshment rack.

FIG. 5 is a perspective view similar to FIGS. 2 and 4, illustrating a removable handle 110 attached to the refreshment rack. The refreshment rack of FIG. 5 comprises a single rod circular base 94 and arcuate transition section 96, and terminates in an incomplete loop 98. This embodiment also includes a supplemental drinkware support 100 comprising a rod transverse section 102 brazed or otherwise attached to the arcuate transition section 96, as previously described, the transverse section transforming into parallel arcuate transition sections 104, and terminating in identical open hooks 106. These open hooks 106, unlike previously described open and closed rod loops, comprise identical hook portions oriented in two parallel planes of respective arcuate transition sections 104. The open hooks of the FIG. 5 embodiment are adapted to receive therein looped handles of drinkware items, as in mugs or cups.

The refreshment rack 92 of FIG. 5 also includes the food service bowl 108 for holding snack foods, as in chips, crackers, etc. As in previous embodiments, this food service bowl 108 is removable and interchangeable in the various bases of the disclosed embodiments.

The embodiment of FIG. 5 also includes a removable handle 110 for removably attaching to the rack for manually transporting the rack (including bottle, drinkware, and snack food). The removable handle 110 includes a hand grip section 112 formed of an elongated loop of rod, the hand grip section terminating in an arcuate transition section 114, comprising the two rod extensions of the elongate loop, attached together as previously described. The two rod portions of the arcuate transition section 114 each terminate in a respective transverse member 116, each of which terminates in an inwardly oriented hook 118 for removably hooking onto respective arcuate transition sections 104 of the refreshment rack drinkware support.

Those skilled in the art will readily appreciate that, when the handle 110 is attached by its hooks 118 to respective arcuate sections 104 of the refreshment rack, upward lifting force of the handle will cause the hooks to torque or otherwise bind against the rod sections 104 in order to lift the entire rack, including filled bottle, drinkware, and snack-food bowl for manually carrying the rack about. The inventors have found that the addition of rubber sleeves 120 on the rod material of the hooks 118 will insure that the hooks do not slip along the respective arcuate transition sections 104, even when torquing force is removed from the handle.

The handle 110 is easily removable from the refreshment rack 92, and specifically from the arcuate transition sections 104 of the supplemental drinkware support by: (1) relieving the torquing force of the hooks on the transition sections 104 by lowering the hand grip section 112 of the handle, and (2) manually squeezing together the open hooks 106, which will draw the arcuate transition sections 104 inwardly sufficiently to free the transition sections 104 from the hooks 118. Reinstallation of the handle 110 is the reverse of the removal process. Specifically, the user: (1) manually urges the hooks 106 together sufficiently to enable the two arcuate transition sections 104 to "clear" the ends of the hooks 118, while he positions the hooks in position to receive the arcuate transition sections 104 therein when released, and (2) with the arcuate sections 104 released to locate themselves within respective hooks 118, lifts upwardly on the handle grip section 112 in order to torque the hooks 118 against the arcuate transition section 104. So attached, the handle 110 can be used to transport the refreshment rack about, and then can be easily removed to permit freer access to the bottle, drinkware and snackfood in the bowl. It should be noted that the removable handle 110 is attachable to the embodiments of FIGS. 2 and 4 also, in a similar manner.

Figure 6:
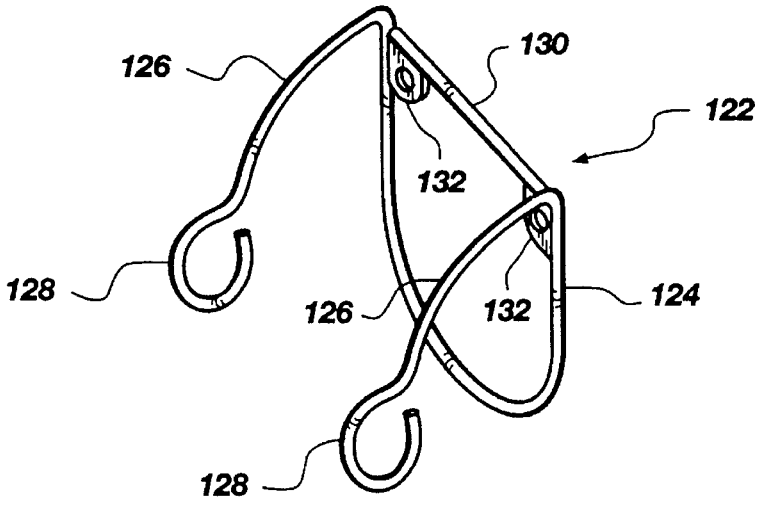
FIG. 6 is a pictorial view of a wall-mountable refreshment rack.

FIG. 6 is a perspective view of a wall-mountable refreshment rack, generally illustrated at 122. The wall-mountable rack includes a rod base 124 comprising a "U" shaped section, the ends of the "U" transforming into outwardly and downwardly curving arcuate transition sections 126, terminating in respective incomplete loops 128. As in the previous embodiments, these loops 128 are sized and angled relative to vertical in a manner to support a long-necked bottle in cantilever fashion essentially horizontally. In the wall-mountable rack 122 of FIG. 6, the loops 128 support the bottle necks adjacent the wall, with the bases of the bottles extending essentially horizontally away from the wall. The base 124 also includes a transverse section 130 which is brazed or otherwise attached to the juncture of the base and arcuate transition sections, as previously described. In addition, bosses 132 are provided in the base both for structural integrity and for providing attachment holes for screw-attaching the wall-mountable rack to a vertical wall.

From the foregoing, it will be seen that this invention is one well adapted to attain all of the ends and objectives herein set forth, together with other advantages which are obvious and which are inherent to the apparatus. It will be understood that certain features and subcombinations are of utility and may be employed with reference to other features and subcombinations. This is contemplated by and is within the scope of the claims. As many possible embodiments may be made of the invention without departing from the scope of the claims. For example, although the invention has been shown and described as being formed of structural metallic rod material brazed or welded together, it should be apparent that the device may also be constructed of wood, plastic or other suitable structural material, and may be attached together in accordance with the particular material. The device may be formed as a unit, as in casted or moulded, or formed as separate casted or moulded pieces attached together. In addition, the particular material may have a cross-section that is round, square, elliptical, tubular, or other ornamental profile. Likewise, the serving tray may be constructed of wood, ceramic, rock, plastic, metal, or other suitable material. Likewise, the base may be formed in any ornamental shape (e.g., square, rectangular, triangular, heart, etc.) rather than the circular configuration shown and described. It is to be understood that all matter herein set forth or shown in the accompanying drawings is to be interpreted as illustrative and not in a limiting sense.

What is claimed is:

1. A refreshment rack comprising a rod support base and a rod bottle supporting element formed with said base, said bottle supporting element consisting of a single, round, and essentially complete loop adapted to receive the neck only of a bottle therein and to support the bottle by its neck in cantilever fashion.

2. A refreshment rack as set forth in claim 1, further comprising a plurality of bottle supporting elements.

3. A refreshment rack as set forth in claim 1, wherein said bottle supporting element supports the bottle directly above said base.

4. A refreshment rack as set forth in claim 1, wherein said base is oriented vertically for attachment to a wall.

5. A refreshment rack as set forth in claim 4, further comprising a plurality of bottle supporting elements.

6. A refreshment rack as set forth in claim 4, wherein said bottle supporting element comprises a loop of rod sized and angled to support a bottle by its neck adjacent the base in cantilever fashion in approximate perpendicular relationship to said base.

7. A refreshment rack comprising:

a rod base;

a rod bottle supporting element formed with said rod base, said bottle supporting element adapted to receive the neck of a bottle therein and support the bottle in cantilever fashion; and a plurality of rod drinkware holders formed with said rod base and said rod bottle supporting element.

8. A refreshment rack as set forth in claim 7, further comprising a rod handle for attachment to said refreshment rack.

9. A refreshment rack as set forth in claim 8, wherein said handle is removable from said refreshment rack.

10. A refreshment rack as set forth in claim 8, wherein said handle includes an enlarged gripping section.

11. A refreshment rack as set forth in claim 7, wherein said drinkware holders comprise horizontally oriented essentially circular rod sections for receiving drinkware therein.

12. A refreshment rack as set forth in claim 7, wherein said drinkware holders comprise essentially vertically oriented open rod loops defining hooks.

13. A refreshment rack comprising a rod base, said base including a serving tray, and a rod bottle supporting element formed with said base, said bottle supporting element being adapted to receive the neck of a bottle therein.

14. A refreshment rack as set forth in claim 3, wherein said serving tray is removable.

15. A refreshment rack as set forth in claim 14, wherein said serving tray includes knife holding means.

16. A refreshment rack as set forth in claim 14, wherein said serving tray comprises a bowl.

17. A refreshment rack as set forth in claim 13, wherein said tray comprises a coaster.

18. A refreshment rack as set forth in claim 1, wherein the bottle is supported in essentially horizontal orientation.

19. A refreshment rack as set forth in claim 1, wherein the bottle neck is supported in 3-point contact within said single loop bottle supporting element.

* * * * *